US007749332B2

(12) United States Patent
Jonke et al.

(10) Patent No.: US 7,749,332 B2
(45) Date of Patent: Jul. 6, 2010

(54) DETERGENT/CLEANING AGENTS WITH A GELLAN GUM THICKENING SYSTEM, METHODS FOR USING THE SAME AND CLEANING SUBSTRATES CONTAINING THE SAME

(75) Inventors: Hermann Jonke, Düsseldorf (DE); Hans-Jürgen Riebe, Solingen (DE); Piotr Malecki, Wegberg-Arsbeck (DE); Alexander Lambotte, Düsseldorf (DE); Thomas Plantenberg, Mettmann (DE)

(73) Assignee: Henkel KGaA, Dusseldorf (DE)

( * ) Notice: Subject to any disclaimer, the term of this patent is extended or adjusted under 35 U.S.C. 154(b) by 484 days.

(21) Appl. No.: 11/661,021

(22) PCT Filed: Jun. 24, 2005

(86) PCT No.: PCT/EP2005/006836

§ 371 (c)(1),
(2), (4) Date: Mar. 27, 2007

(87) PCT Pub. No.: WO2006/021255

PCT Pub. Date: Mar. 2, 2006

(65) Prior Publication Data

US 2007/0215184 A1 Sep. 20, 2007

(30) Foreign Application Priority Data

Aug. 23, 2004 (DE) ..... 10 2004 040 849

(51) Int. Cl.

| | |
|---|---|
| ***B08B 3/04*** | (2006.01) |
| ***C11D 9/00*** | (2006.01) |
| ***C11D 1/20*** | (2006.01) |
| ***C11D 3/22*** | (2006.01) |
| ***C11D 3/37*** | (2006.01) |

(52) U.S. Cl. ..... 134/25.2; 134/25.3; 134/39; 134/42; 510/238; 510/251; 510/430; 510/437; 510/470; 510/475; 510/477; 510/481; 424/401; 424/456; 424/70.11; 424/70.16

(58) Field of Classification Search ..... 510/238, 510/251, 430, 437, 470, 475, 477, 481; 134/25.2, 134/25.3, 39, 42; 424/401, 456, 70.11, 70.16
See application file for complete search history.

(56) References Cited

U.S. PATENT DOCUMENTS

| | | | | |
|---|---|---|---|---|
| 3,234,258 | A | 2/1966 | Morris | |
| 4,820,439 | A | 4/1989 | Rieck | |
| 5,075,041 | A | 12/1991 | Lutz | |
| 5,356,607 | A | 10/1994 | Just | |
| 5,780,420 | A | 7/1998 | Breuer et al. | |
| 6,051,250 | A | 4/2000 | Ribier et al. | |
| 6,362,156 | B1 * | 3/2002 | Hsu et al. | 510/418 |
| 7,393,820 | B2 | 7/2008 | Soldanski et al. | |
| 2004/0009139 | A1 | 1/2004 | Oldenhove | |

FOREIGN PATENT DOCUMENTS

| | | |
|---|---|---|
| DE | 44 00 024 | 7/1995 |
| DE | 101 11 536 | 9/2002 |
| DE | 10248313 | 5/2004 |
| EP | 0 164 514 | 12/1985 |
| EP | 0 985 410 | 3/2000 |
| EP | 1 473 357 | 11/2004 |
| FR | 1 156 513 | 5/1958 |
| GB | 839407 | 6/1960 |
| GB | 873214 | 7/1961 |
| GB | 1 471 406 | 4/1977 |
| GB | 2384705 | 8/2003 |
| JP | 58/217598 | 12/1983 |
| WO | WO-90/13533 | 11/1990 |
| WO | WO-91/08171 | 6/1991 |
| WO | WO 93/22417 | 11/1993 |
| WO | WO-95/07331 | 3/1995 |
| WO | WO-97/12027 | 4/1997 |
| WO | WO-00/36066 | 6/2000 |
| WO | WO-00/36078 | 6/2000 |
| WO | WO-01/00765 | 1/2001 |
| WO | WO-2004/074421 | 9/2004 |
| WO | WO-2004/074422 | 9/2004 |

* cited by examiner

*Primary Examiner*—Brian P Mruk
(74) *Attorney, Agent, or Firm*—Connolly Bove Lodge & Hutz LLP

(57) ABSTRACT

Aqueous compositions comprising: (a) a surfactant; and (b) a thickening system comprising: (i) a gellan gum; and (ii) a thickener selected from the group consisting of polyacrylate thickeners, xanthan gums, guar flours, alginates, carrageenans, carboxy -methylcelluloses, bentonites, wellan gums, carob flours and mixtures thereof; wherein the surfactant comprises a fatty acid soap, and wherein the fatty acid soap is present in an amount of 2 to 20 % by weight based on the composition are disclosed, along with uses therefor.

20 Claims, No Drawings

DETERGENT/CLEANING AGENTS WITH A GELLAN GUM THICKENING SYSTEM, METHODS FOR USING THE SAME AND CLEANING SUBSTRATES CONTAINING THE SAME

CROSS-REFERENCE TO RELATED APPLICATIONS

This application is a national stage application, under 35 U.S.C. §371, of PCT/EP2005/006836 filed Jun. 24, 2005, which claims benefit of German application 10 2004 040 849.1 filed Aug. 23, 2004.

BACKGROUND OF THE INVENTION

The invention relates to an aqueous liquid detergent and cleaning agent, containing surfactant(s) and further conventional ingredients of detergents and cleaning agents.

The incorporation of certain active substances (e.g. bleaches, enzymes, perfumes, dyes, etc.) into liquid detergents and cleaning agents can lead to problems. For example, incompatibilities may occur between the individual active components of the liquid detergents and cleaning agents. This can lead to undesired discolorations, agglomerations, odor problems and destruction of detergent active substances.

However, the consumer demands liquid detergents and cleaning agents which optimally display their action at the time of use even after storage and transport. This requires that the ingredients of the liquid detergent and cleaning agent have not settled, decomposed or volatilized beforehand.

By complicated and accordingly expensive packaging, for example, the loss of volatile components can be prevented. Chemically incompatible components can be stored separately from the remaining components of the liquid detergent and cleaning agent and then metered for use. The use of opaque packaging prevents the decomposition of light-sensitive components but also has the disadvantage that the consumer cannot see the appearance and amount of the liquid detergent and cleaning agent.

A concept for incorporating sensitive, chemically or physically incompatible and volatile components consists in using particles and in particular microcapsules in which these ingredients are enclosed so as to be stable during storage and transport.

From the cosmetics sector, British patent GB 1 471 406 describes liquid aqueous cleaning agents which contain at least 2% by weight of triethanolamine laurylsulfate, in total from 8 to 50% by weight of surfactant and from 0.1 to 5% by weight of a suspended phase, for example spheroidal capsules having a diameter of from 0.1 to 5 mm, and have a pH of from 5.5 to 11. A homogeneous distribution of the suspended phase is achieved by using water-soluble acrylic acid polymers, such as, for example, Carbopol 941.

WO 93/22417 discloses liquid cleaning compositions which contain from 5 to 85% by weight of surfactant and from 0.1 to 10% by weight of polymer capsules having a size of less than 250 μm. The polymer capsules contain sensitive cleaning-active substances and polymer compositions consisting of a hydrophobic polymer core and a hydrophilic polymer in a ratio of from 2:8 to 7:3.

WO 97/12027 discloses liquid detergents having a pH of from 5 to 9 (at 10% dilution), which contain from 10 to 40% by weight of anionic surfactants, from 1 to 10% by weight of amine oxides, less than 10% by weight of solvent and from 0 to 10% by weight of electrolyte. The liquid has a viscosity of from 100 to 4000 cps at a shear rate of 20 $s^{-1}$ and is capable of suspending particles up to a size of 200 μm.

One possibility for suspending particles in a liquid is the use of structured liquids. A distinction is made there between internal and external structuring. External structuring can be achieved, for example, by using structuring gums, such as, for example, xanthan gum, guar gum, carob flour, gellan gum, wellan gum or carrageenan.

From the esthetic point of view, it is desirable for the liquid detergents in which the particles are suspended to be transparent or at least translucent. However, the use of structuring gums often leads to an opaque composition.

The liquid aqueous cleaning agent described in GB 1 471 406 is clear but, owing to the use of the polyacrylate thickener, has no flow limit.

WO 00/36078 describes transparent/translucent liquid detergents which are capable of suspending particles having a size of from 300 to 5000 μm, comprising at least 15% by weight of surfactant and from 0.01 to 5% by weight of a polymeric gum. The Application contains no information about whether the liquid detergents have flow limits. In addition, the liquid detergents described there have only small amounts of fatty acid soaps (≦1.42% by weight).

BRIEF SUMMARY OF THE INVENTION

It is therefore an object of the present invention to provide a clear detergent and cleaning agent which has a flow limit, is stable during storage and transport and is capable of homogeneously dispersing particles.

This object is achieved by an aqueous liquid detergent and cleaning agent, containing surfactant(s) and further conventional ingredients of detergents and cleaning agents, the composition containing, as a thickening system, based in each case on the total composition a) gellan gum and b) a thickener selected from the group consisting of a polyacrylate thickener, xanthan gum, guar flour, alginate, carrageenan, carboxymethylcellulose, bentonites, wellan gum and carob flour.

Surprisingly, it was found that the combination of gellan gum with a further thickener leads to clear detergents and cleaning agents having a flow limit which are stable during storage.

It is preferable if the amount of gellan gum in the detergent and cleaning agent is from 0.01 to 0.5% by weight and preferably from 0.05 to 0.5% by weight.

It is furthermore preferable if, with the use of a polyacrylate thickener as a second component of the thickening system, the amount of polyacrylate thickener is from 0.01 to 1.0% by weight and preferably from 0.1 to 1.0% by weight.

It is also preferable if, with the use of a xanthan gum as a second component of the thickening system, the amount of xanthan gum is from 0.01 to 1.0% by weight and preferably from 0.05 to 0.5% by weight.

These combinations of thickener systems lead to clear thickened detergents and cleaning agents having flow limits, in which the viscosity of the end product can be varied within wide limits and more or less "liquid" compositions can thus be prepared.

In a preferred embodiment, the detergent and cleaning agent contains dispersed particles, particularly preferably microcapsules or speckles, whose diameter along their greatest dimension is from 0.01 to 10 000 μm.

Particularly by using microcapsules, sensitive, chemically or physically incompatible and volatile components of the aqueous liquid detergent and cleaning agent can be enclosed so as to be stable during storage and transport and can be homogeneously dispersed in the aqueous liquid detergent and cleaning agent. This ensures, inter alia, that the detergent and cleaning agent is available to the consumer with full detergent and cleaning power at the time of use.

In a particularly preferred embodiment, the detergent and cleaning agent contains from 2 to 20% by weight, preferably from 4 to 10% by weight and very particularly preferably from 6 to 8% by weight of fatty acid soap.

Fatty acid soaps are an important constituent for the detergent power of an aqueous liquid detergent and cleaning agent. Surprisingly, it has been found that, with the use of a thickening system comprising gellan gum and a thickener which may be a polyacrylate thickener, xanthan gum, guar flour, alginate, carrageenan, carboxymethylcellulose, bentonites, wellan gum and carob flour, clear, stable and thickened liquid detergents and cleaning agents having a flow limit are obtained. Usually, the use of large amounts (≧2% by weight) of fatty acid soap in such systems leads to opaque and unstable products.

DETAILED DESCRIPTION OF THE INVENTION

Below, the detergents and cleaning agents according to the invention are described in detail, inter alia with reference to examples.

The thickening system contains gellan gum as mandatory component. Gellan gum is a straight-chain anionic microbial heteroexopolysaccharide having a tetrasaccharide parent unit, consisting of the monomers glucose, glucuronic acid and rhamnose. Gellan gum forms after heating and cooling of thermoreversible gels. The gels are stable over a wide temperature and pH range. The amount (based on the total composition) of gellan gum in the detergent and cleaning agent is preferably from 0.01 to 0.5% by weight and particularly preferably from 0.05 to 0.5% by weight. Gellan gum can be obtained, for example, under the trade name Kelcogel® in various qualities from Kelco.

As a second component, the thickening system contains a thickener selected from the group consisting of a polyacrylate thickener, xanthan gum, guar flour, alginate, carrageenan, carboxymethylcellulose, bentonites, wellan gum and carob flour. Of the abovementioned thickeners, a polyacrylate thickener and xanthan gum are preferred.

The polyacrylate and polymethacrylate thickeners include, for example, the high molecular weight homopolymers of acrylic acid which have crosslinked with a polyalkenylpolyether, in particular an allyl ether of sucrose, pentaerythritol or propylene (INCI designation according to "International Dictionary of Cosmetic Ingredients" of "The Cosmetic, Toiletry and Fragrance Association (CTFA)": carbomer) and which are also referred to as carboxyvinyl polymers. Such polyacrylic acids are available, inter alia, from 3V Sigma under the trade name Polygel®, e.g. Polygel DA, and from B.F. Goodrich under the trade name Carbopol®, e.g. Carbopol 940 (molecular weight about 4 000 000), Carbopol 941 (molecular weight about 1 250 000) or Carbopol 934 (molecular weight about 3 000 000). Furthermore, the following acrylic acid copolymers are included there: (i) copolymers of two or more monomers from the group consisting of acrylic acid, methacrylic acid and their simple esters, preferably formed with $C_{1-4}$-alkanols (INCI Acrylates Copolymer), to which, for example, the copolymers of methacrylic acid, butyl acrylate and methyl methacrylate (CAS designation according to Chemical Abstracts Service: 25035-69-2) or of butyl acrylate and methyl methacrylate (GAS 25852-37-3) belong and which are available, for example, from Rohm & Haas under the trade names Aculyn® and Acusol® and from Degussa (Goldschmidt) under the trade name Tego® polymer, e.g. the anionic nonassociative polymers Aculyn 22, Aculyn 28, Aculyn 33 (crosslinked), Acusol 810, Acusol 823 and Acusol 830 (CAS 25852-37-3); (ii) crosslinked high molecular weight acrylic acid copolymers, to which, for example, the copolymers of $C_{10-30}$-alkyl acrylates with one or more monomers from the group consisting of acrylic acid, methacrylic acid and their simple esters preferably formed with $C_{1-4}$-alkanols (INCI Acrylates/C10-30 Alkyl Acrylate Crosspolymer) belong, said copolymers being crosslinked with an allyl ether of sucrose or of pentaerythritol, and which are available, for example, from B.F. Goodrich under the trade name Carbopol®, e.g. the hydrophobized Carbopol ETD 2623 and Carbopol 1382 (INCI Acrylates/C10-30 Alkyl Acrylate Crosspolymer) and Carbopol Aqua 30 (formerly Carbopol EX 473).

Preferred aqueous liquid detergents and cleaning agents contain, as component b) of the thickening system, based in each case on the total composition, from 0.01 to 1% by weight, preferably from 0.05 to 1% by weight and particularly preferably from 0.1 to 0.5% by weight of polyacrylate thickener.

A further polymeric thickener to be preferably used is xanthan gum, a microbial anionic heteropolysaccharide which is produced from Xanthomonas campestris and some other species under aerobic conditions and has a molar mass of from 2 to 15 million daltons. Xanthan is formed from a chain with β-1,4-bonded glucose (cellulose) having side chains. The structure of the subgroups consists of glucose, mannose, glucuronic acid, acetate and pyruvate, the number of pyruvate units determining the viscosity of the xanthan gum.

Xanthan gum can be described by the following formula (1):

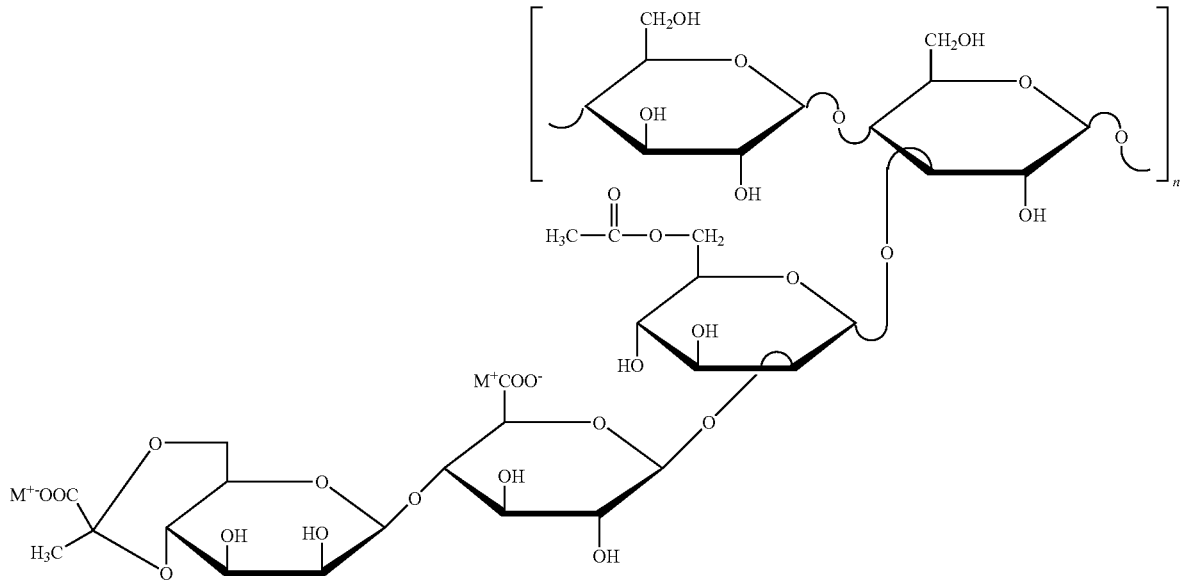

M+ = Na, K, 1/2 Ca

Xanthan gum is available, for example, from Kelco under the trade names Keltrol® and Kelzan® and also from Rhodia under the trade name Rhodopol®.

Preferred aqueous liquid detergents and cleaning agents contain, as component b) of the thickening system, based in each case on the total composition, from 0.01 to 1% by weight and preferably from 0.1 to 0.5% by weight of xanthan gum.

The ratio of gellan gum to the thickener (component b) of the thickening system) is preferably from 10:1 to 1:50 and very particularly preferably from 1:1 to 1:5.

In addition to the thickening system, the liquid detergents and cleaning agents contain surfactant(s) it being possible to use anionic, nonionic, cationic and/or amphoteric surfactants. From the point of view of application technology, mixtures of anionic and nonionic surfactants are preferred. The total surfactant content of the liquid detergent and cleaning agent is preferably below 40% by weight and particularly preferably below 35% by weight, based on the total liquid detergent and cleaning agent.

Preferably used nonionic surfactants are alkoxylated, advantageously ethoxylated, in particular primary alcohols having preferably from 8 to 18 carbon atoms and on average from 1 to 12 mol of ethylene oxide (EO) per mole of alcohol, in which the alcohol radical may be linear or preferably methyl-branched in the 2-position or may contain a mixture of linear and methyl-branched radicals, as are usually present in oxo alcohol radicals. However, alcohol ethoxylates with linear radicals of alcohols of natural origin having 12 to 18 carbon atoms, for example of coconut, palm, tallow fatty or oleyl alcohol, and on average from 2 to 8 EO per mole of alcohol are particularly preferred. The preferred ethoxylated alcohols include, for example, $C_{12-14}$-alcohols having 3 EO, 4 EO or 7 EO, $C_{9-11}$-alcohol having 7 EO, $C_{13-15}$-alcohols having 3 EO, 5 EO, 7 EO or 8 EO, $C_{12-18}$-alcohols having 3 EO, 5 EO or 7 EO and mixtures of these, such as mixtures of $C_{12-14}$-alcohol having 3 EO and $C_{12-18}$-alcohol having 7 EO. The stated degrees of ethoxylation are statistical mean values which may be an integer or a fraction for a specific product. Preferred alcohol ethoxylates have a narrow homolog distribution (narrow range ethoxylates, NRE). In addition to these nonionic surfactants, it is also possible to use fatty alcohols having more than 12 EO. Examples of these are tallow fatty alcohol having 14 EO, 25 EO, 30 EO or 40 EO. Nonionic surfactants which contain EO and PO groups together in the molecule can also be used according to the invention. Here, block copolymers having EO-PO block units or PO-EO block units can be used, but also EO-PO-EO copolymers or PO-EO-PO copolymers. It is of course also possible to use niosurfactants which have mixed alkoxylation and in which EO and PO units are distributed not blockwise but randomly. Such products are obtainable by simultaneous action of ethylene oxide and propylene oxide on fatty alcohols.

In addition, alkylglycosides of the general formula RO $(G)_x$, in which R is a primary aliphatic radical having 8 to 22, preferably 12 to 18, carbon atoms which is straight-chain or methyl-branched, in particular methyl-branched in the 2-position, and G is the symbol which represents a glycose unit having 5 or 6 carbon atoms, preferably glucose, can also be used as further nonionic surfactants. The degree of oligomerization x, which indicates the distribution of monoglycosides and oligoglycosides, is any desired number from 1 to 10; preferably, x is from 1.2 to 1.4.

A further class of preferably used nonionic surfactants, which are used either as the sole nonionic surfactant or in combination with other nonionic surfactants, are alkoxylated, preferably ethoxylated or ethoxylated and propoxylated, fatty acid alkyl esters, preferably having 1 to 4 carbon atoms in the alkyl chain, in particular fatty acid methyl esters, as described, for example, in Japanese patent application JP 58/217598 or which are preferably prepared by the process described in international patent application WO-A-90/13533.

Nonionic surfactants of the type consisting of the amine oxides, for example N-cocosalkyl-N,N-dimethylamine oxide and N-tallow alkyl-N,N-dihydroxyethylamine oxide, and of the fatty acid alkanolamides may also be suitable. The amount of these nonionic surfactants is preferably not more than that of the ethoxylated fatty alcohols, in particular not more than half thereof.

Further suitable surfactants are polyhydroxy-fatty acid amides of the formula (2),

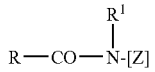

(2)

in which RCO is an aliphatic acyl radical having 6 to 22 carbon atoms, $R^1$ is hydrogen or an alkyl or hydroxyalkyl radical having 1 to 4 carbon atoms and [Z] is a linear or branched polyhydroxyalkyl radical having 3 to 10 carbon atoms and 3 to 10 hydroxyl groups. The polyhydroxy-fatty acid amides are known substances which can usually be obtained by reductive amination of a reducing sugar with ammonia, an alkylamine or an alkanolamine and subsequent acylation with a fatty acid, a fatty acid alkyl ester or a fatty acid chloride.

The group consisting of the polyhydroxy-fatty acid amides also includes compounds of the formula (3),

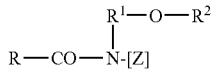

(3)

in which R is a linear or branched alkyl or alkenyl radical having 7 to 12 carbon atoms, $R^1$ is a linear, branched or cyclic alkyl radical or an aryl radical having 2 to 8 carbon atoms and $R^2$ is a linear, branched or cyclic alkyl radical or an aryl radical or an oxyalkyl radical having 1 to 8 carbon atoms, $C_{1-4}$-alkyl or phenyl radicals being preferred, and [Z] is a linear polyhydroxyalkyl radical whose alkyl chain is substituted by at least two hydroxyl groups, or alkoxylated, preferably ethoxylated or propoxylated, derivatives of this radical.

[Z] is preferably obtained by reductive amination of a sugar, for example glucose, fructose, maltose, lactose, galactose, mannose or xylose. The N-alkoxy- or N-aryloxy-substituted compounds can then be converted into the desired polyhydroxy-fatty acid amides, for example according to the teaching of the international application WO-A-95/07331, by reaction with fatty acid methyl esters in the presence of an alkoxide as a catalyst.

The content of nonionic surfactants in the liquid detergents and cleaning agents is preferably from 5 to 30% by weight, preferably from 7 to 20% by weight and in particular from 9 to 15% by weight, based in each case on the total composition.

Anionic surfactants used are, for example, those of the type consisting of the sulfonates and sulfates. Suitable surfactants of the sulfonate type are preferably $C_{9-13}$-alkylbenzenesulfonates, olefinsulfonates, i.e. mixtures of alkene- and hydroxyalkanesulfonates, and disulfonates, as obtained, for example, from $C_{12-18}$-monoolefins having a terminal or internal double bond by sulfonation with gaseous sulfur trioxide and subsequent alkaline or acidic hydrolysis of the sulfonation products. Alkanesulfonates which are obtained from $C_{12-18}$-alkanes, for example by sulfochlorination or sulfoxidation with subsequent hydrolysis or neutralization, are also suitable. The esters of α-sulfo-fatty acids (ester sulfonates), for example the α-sulfonated methyl esters of hydrogenated coconut, palm kernel or tallow fatty acids, are also suitable.

Further suitable anionic surfactants are sulfited fatty acid glyceryl esters. Fatty acid glyceryl esters are to be understood as meaning the mono-, di- and triesters and mixtures thereof, as obtained in the preparation by esterification of a monoglycerol with from 1 to 3 mol of fatty acid or in the transesterification of triglycerides with from 0.3 to 2 mol of glycerol. Preferred sulfited fatty acid glyceryl esters are the sulfination products of saturated fatty acids having 6 to 22 carbon atoms, for example of caproic acid, caprylic acid, capric acid, myristic acid, lauric acid, palmitic acid, stearic acid or behenic acid.

Preferred alk(en)ylsulfates are the alkali metal and in particular the sodium salts of sulfuric acid monoesters of $C_{12}$-$C_{18}$-fatty alcohols, for example of coconut fatty alcohol, tallow fatty alcohol, lauryl, myristyl, cetyl or stearyl alcohol or of the $C_{10}$-$C_{20}$-oxo alcohols and those monoesters of secondary alcohols of these chain lengths. Furthermore preferred are alk(en)ylsulfates of said chain length which contain a synthetic straight-chain alkyl radical which is prepared on petrochemical basis and have a degradation behavior similar to that of the adequate compounds based on fat chemical raw materials. From the point of view of washing, $C_{12}$-$C_{16}$-alkylsulfates and $C_{12}$-$C_{15}$-alkylsulfates and $C_{14}$-$C_{15}$-alkylsulfates are preferred. 2,3-Alkylsulfates, which are prepared, for example, according to U.S. Pat. Nos. 3,234,258 or 5,075,041 and can be obtained as commercial products from Shell Oil Company under the name DAN®, are also suitable anionic surfactants.

Sulfuric acid monoesters of the straight-chain or branched $C_{7-21}$-alcohols ethoxylated with from 1 to 6 mol of ethylene oxide, such as 2-methyl-branched $C_{9-11}$-alcohols having on average 3.5 mol of ethylene oxide (EO) or $C_{12-18}$-fatty alcohols having from 1 to 4 EO, are also suitable. Owing to their good foam behavior, they are useful in cleaning agents only in relatively small amounts, for example in amounts of from 1 to 5% by weight.

Further suitable anionic surfactants are also the salts of alkyl-sulfosuccinic acid, which are also referred to as sulfosuccinates or as sulfosuccinic esters, and the monoesters and/or diesters of sulfosuccinic acid with alcohols, preferably fatty alcohols and in particular ethoxylated fatty alcohols. Preferred sulfosuccinates contain $C_{8-18}$-fatty alcohol radicals or mixtures of these. Particularly preferred sulfosuccinates contain a fatty alcohol radical which is derived from ethoxylated fatty alcohols which, considered by themselves, are nonionic surfactants (for description, see below). Once again, sulfosuccinates whose fatty alcohol radicals are derived from ethoxylated fatty alcohols having a narrow homolog distribution are particularly preferred. It is also possible to use alk(en)ylsuccinic acid having preferably 8 to 18 carbon atoms in the alk(en)yl chain or salts thereof.

Particularly preferred anionic surfactants are soaps. Saturated and unsaturated fatty acid soaps, such as the salts of lauric acid, myristic acid, palmitic acid, stearic acid, (hydrogenated) erucic acid and behenic acid and soap mixtures derived in particular from natural fatty acids, for example coconut, palm kernel, olive oil or tallow fatty acids, are suitable.

The anionic surfactants, including the soaps, may be present in the form of their sodium, potassium or ammonium salts and as soluble salts of organic bases, such as mono-, di- or triethanolamine. The anionic surfactants are preferably present in the form of their sodium or potassium salts, in particular in the form of the sodium salts.

The content of anionic surfactants in preferred liquid detergents and cleaning agents is from 2 to 30% by weight, preferably from 4 to 25% by weight and in particular from 5 to 22% by weight, based in each case on the total composition. It is particularly preferable if the amount of fatty acid soap is at least 2% by weight and particularly preferably at least 4% by weight and especially preferably at least 6% by weight.

The viscosity of the liquid detergents and cleaning agents can be measured using conventional standard methods (for example Brookfield Viscometer LVT-II at 20 rpm and 20° C., spindle 3) and is preferably in the range from 500 to 5000 mPa·s. Preferred compositions have viscosities of from 700 to 4000 mPa·s, values of from 1000 to 3000 mPa·s being particularly preferred.

In addition to the thickening system and to the surfactant(s), the liquid detergents and cleaning agents may contain further ingredients which further improve the performance characteristics and/or esthetic properties of the liquid detergent and cleaning agent. For the purposes of the present invention, preferred compositions additionally contain the structuring agents and to surfactant(s) one or more substances from the group consisting of builders, bleaches, bleach activators, enzymes, electrolytes, nonaqueous solvents, pH adjusters, fragrances, perfume carriers, fluorescent compositions, dyes, hydrotopes, foam inhibitors, silicone oils, antiredeposition agents, optical brighteners, graying inhibitors, shrinkage inhibitors, anticrease agents, color transfer inhibitors, antimicrobial active substances, germicides, fungicides, antioxidants, corrosion inhibitors, antistatic agents, ironing auxiliaries, repellants and impregnating agents, swelling agents and anti-slip agents and UV absorbers.

In particular, silicates, aluminum silicates (in particular zeolites), carbonates, salts of organic di- and polycarboxylic acids and mixtures of these substances may be mentioned as builders which may be present in the liquid detergents and cleaning agents.

Suitable crystalline, layer-like sodium silicates have the general formula $NaMSi_xO_{2x+1}.H_2O$, in which M is sodium or hydrogen, x is a number from 1.9 to 4 and y is a number from 0 to 20 and preferred values for x are 2, 3 or 4. Such crystalline layer silicates are described, for example, in European patent application EP-A-0 164 514. Preferred crystalline layer silicates of said formula are those in which M is sodium and x assumes the values 2 or 3. In particular, both β- and δ-sodium disilicates $Na_2Si_2O_5.yH_2O$ are preferred, it being possible to obtain β-sodium disilicate, for example, by the process which is described in the international patent application WO-A-91/08171.

Amorphous sodium silicates having an $Na_2O:SiO_2$ modulus of from 1:2 to 1:3.3, preferably from 1:2 to 1:2.8 and in particular from 1:2 to 1:2.6, which exhibit retarded dissolution and have secondary detergent properties, can also be used. The retardance of dissolution compared with conventional amorphous sodium silicates may have been caused in various ways, for example by surface treatment, compounding, compacting/compression or by overdrying. In the context of this invention, the term "amorphous" is also understood as meaning "X-ray amorphous". This means that, in X-ray diffraction experiments, the silicates do not give sharp X-ray reflections as are typical for crystalline substances but at best one or more maxima of the scattered X-radiation which have a width of several degree units of the diffraction angle. However, it may very well even lead to particularly good builder properties if the silicate particles give blurred or even sharp diffraction maxima in electron diffraction experiments. The interpretation of this is that the products have microcrystalline regions having a size of from 10 to a few hundred nm, values up to not more than 50 nm and in particular up to not more than 20 nm being preferred. Such so-called X-ray amorphous silicates which also exhibit retarded dissolution compared with the conventional waterglasses are described, for example, in German patent application DE-A44 00 024. Compressed/compacted amorphous silicates, compounded amorphous silicates and overdried X-ray amorphous silicates are particularly preferred.

The finely crystalline, synthetic zeolite used, which contains bound water, is preferably zeolite A and/or P. Zeolite MAP® (commercial product from Crosfield) is particularly preferred as zeolite P. However, zeolite X and mixtures of A, X and/or P are also suitable. For example, a co-crystallization product of zeolite X and zeolite A (about 80% by weight of zeolite X), which is sold by SASOL under the trade name VEGOBOND AX® and can be described by the formula $$nNa_2O.(1-n)K_2O.Al_2O_3.(2\text{-}2.5)SiO_2.(3.5\text{-}5.5)H_2O$$

$$n=0.90\text{-}1.0$$

is commercially available and can also preferably be used for the purposes of the present invention. The zeolite can be used as spray-dried powder or as undried, stabilized suspension still moist from its preparation. Where the zeolite is used as a suspension this may contain small added amounts of nonionic surfactants as stabilizers, for example from 1 to 3% by weight, based on zeolite, of ethoxylated $C_{12}$-$C_{18}$-fatty alcohols having 2 to 5 ethylene oxide groups, $C_{12}$-$C_{14}$-fatty alcohols having 4 to 5 ethylene oxide groups or ethoxylated isotridecanols. Suitable zeolites have a mean particle size of less than 10 μm (volume distribution; method of measurement: Coulter Counter) and preferably contain from 18 to 22% by weight, in particular from 20 to 22% by weight, of bound water.

The use of the generally known phosphates as builder substances is of course also possible, provided that such a use is not to be avoided for ecological reasons. In particular, the sodium salts of the orthophosphates, of the pyrophosphates and in particular of the tripolyphosphates are suitable.

Among the compounds which serve as bleaches and donate $H_2O_2$ in water, sodium perborate tetrahydrate and sodium perborate monohydrate are particularly important. Further bleaches which may be used are, for example, sodium percarbonate, peroxypyrophosphates, citrate perhydrates and $H_2O_2$-donating peracid salts or peracids, such as perbenzoates, peroxophthalates, diperazelaic acid, phthaloimino peracid or diperdodecanedioic acid.

In order to achieve an improved bleaching effect when washing at temperatures of 60° C. or below, bleach activators may be incorporated into the detergents and cleaning agents. Bleach activators which may be used are compounds which, under perhydrolysis conditions, give aliphatic peroxocarboxylic acids having preferably 1 to 10 carbon atoms, in particular 2 to 4 carbon atoms, and/or optionally substituted perbenzoic acid. Substances which carry O- and/or N-acyl groups having said number of carbon atoms and/or optionally substituted benzoyl groups are suitable. Polyacylated alkylenediamines, in particular tetraacetylethylenediamine (TAED), acylated triazine derivatives, in particular 1,5-diacetyl-2,4-dioxohexahydro-1,3,5-triazine (DADHT), acylated glycolurils, in particular tetraacetylglycoluril (TAGU), N-acylimides, in particular N-nonanoylsuccinimide (NOSI), acylated phenolsulfonates, in particular n-nonanoyl- or isononanoyloxybenzenesulfonate (n- or iso-NOBS), carboxylic anhydrides, in particular phthalic anhydride, acylated polyhydric alcohols, in particular triacetin, ethylene glycol diacetate and 2,5-diacetoxy-2,5-dihydrofuran are preferred.

In addition to the conventional bleach activators or instead of them, so-called bleaching catalysts may also be incorporated into the liquid detergents and cleaning agents. These substances are transition metal salts or transition metal complexes which enhance the bleaching, such as, for example, Mn, Fe, Co, Ru or Mo salen complexes or carbonyl complexes. Mn, Fe, Co, Ru, Mo, Ti, V and Cu complexes with nitrogen-containing tripod ligands and Co, Fe, Cu and Ru ammine complexes may also be used as bleaching catalysts.

Particularly suitable enzymes are those from the classes consisting of hydrolases, such as the proteases, esterases, lipases or lipolytic enzymes, amylases, cellulases and other glycosyl hydrolases and mixtures of said enzymes. During washing, all these hydrolases contribute to the removal of spots, such as protein-, fat- or starch-containing spots, and graying. Cellulases and other glycosyl hydrolases can also contribute to color preservation and to an increase in the softness of the textile by removing pilling and microfibrils. For bleaching or for inhibiting color transfer, it is also possible to use oxyreductases. Enzymatic active substances obtained from bacterial strains or fungi, such as *Bacillus subtilis, Bacillus licheniformis, Streptomyceus griseus* and *Humicola insolens*, are particularly suitable. Proteases of the subtilisin type and in particular proteases which are obtained from *Bacillus lentus* are preferably used. Enzyme mixtures, for example of protease and amylase or protease and lipase or lipolytic enzymes or protease and cellulase or of cellulase and lipase or lipolytic enzymes or of protease, amylase and lipase or lipolytic enzymes or protease, lipase or lipolytic enzymes and cellulase, but in particular protease and/or lipase-containing mixtures or mixtures with lipolytic enzymes are of particular interest. Examples of such lipolytic enzymes are the known cutinases. Peroxidases or oxidases have also proven suitable in some cases. The suitable amylases include in particular $\alpha$-amylases, isoamylases, pullulanases and pectinases. Preferably used cellulases are cellobiohydrolases, endoglucanases and $\beta$-glucosidases, which are also referred to as cellobiases, or mixtures of these. Since different cellulase types differ in their CMCase and avicelase activities, the desired activities can be established by controlled mixing of the cellulases.

The enzymes may have been adsorbed on carrier substances in order to protect them from premature decomposition. The proportion of the enzymes, enzyme mixtures or enzyme granules may be, for example, from about 0.1 to 5% by weight, preferably from 0.12 to about 2.5% by weight.

A large number of different salts may be used as electrolytes from the group consisting of the inorganic salts. Preferred cations are the alkali and alkaline earth metals, and preferred anions are the halides and sulfates. From the point of view of production, use of NaCl or $MgCl_2$ in the compositions is preferred. The proportion of electrolytes in the compositions is usually from 0.5 to 5% by weight.

Nonaqueous solvents which can be used in the liquid detergents and cleaning agents originate, for example, from the group consisting of monohydric or polyhydric alcohols, alkanolamines or glycol ethers, provided that they are miscible with water in said concentration range. The solvents are preferably selected from ethanol, n-propanol or isopropanol, butanols, glycol, propanediol or butanediol, glycerol, diglycol, propyl- or butyldiglycol, hexylene glycol, ethylene glycol methyl ether, ethylene glycol ethyl ether, ethylene glycol propyl ether, ethylene glycol mono-n-butyl ether, diethylene glycol methyl ether, diethylene glycol ethyl ether, propylene glycol methyl, ethyl or propyl ether, dipropylene glycol monomethyl or monoethyl ether, diisopropylene glycol monomethyl or monoethyl ether, methoxy-, ethoxy- or butoxytriglycol, 1-butoxyethoxy-2-propanol, 3-methyl-3-methoxybutanol, propylene glycol tert-butyl ether and mixtures of these solvents. Nonaqueous solvents may be used in the liquid detergents and cleaning agents in amounts of from 0.5 to 15% by weight, but preferably less than 12% by weight and in particular below 9% by weight.

In order to bring the pH of the liquid detergents and cleaning agents into the desired range, the use of pH adjusters may be appropriate. All known acids or alkalis can be used here provided that their use is not prohibited for reasons relating to performance characteristics or ecological reasons or consumer protection reasons. Usually, the amount of these adjusters does not exceed 7% by weight of the total formulation.

In order to improve the esthetic impression of the liquid detergents and cleaning agents, they may be colored with suitable dyes. Preferred dyes, the choice of which presents no difficulties at all for the person skilled in the art, have a long shelf life and insensitivity to the other ingredients of the compositions and to light and no pronounced substantivity with respect to textile fibers, in order to avoid staining them.

Suitable foam inhibitors which may be used in the liquid detergents and cleaning agents are, for example, soaps, paraffins or silicone oils, which can optionally be applied on carrier materials. Suitable antiredeposition agents, which are also referred to as "soil repellents", are, for example, nonionic cellulose ethers, such as methylcellulose and methylhydroxypropylcellulose having a proportion of from 15 to 30% by weight of methoxy groups and from 1 to 15% by weight of hydroxypropyl groups, based in each case on the nonionic cellulose ether and those polymers of phthalic acid and/or terephthalic acid or of derivatives thereof which are known from the prior art, in particular polymers of ethylene terephthalates and/or polyethylene glycol terephthalates or anionically and/or nonionically modified derivatives of these. Particularly preferred among these are the sulfonated derivatives of phthalic acid and terephthalic acid polymers.

Optical brighteners (so-called "optical bleaching agents") can be added to the liquid detergents and cleaning agents in order to eliminate graying and yellowing of the sheet-like textile structures treated. These substances are absorbed onto the fiber and result in brightening and a simulated bleaching effect by converting invisible ultraviolet radiation into visible longer-wave light, the ultraviolet light absorbed from sunlight being radiated as slightly bluish fluorescence and, with the yellow hue of the grayed or yellowed laundry, giving pure white. Suitable compounds originate, for example, from the classes of substances consisting of 4,4'-diamino-2,2'-stilbenedisulfonic acids (flavonic acids), 4,4'-distyrylbiphenyls, methylumbelliferones, cumarins, dihydroquinolinones, 1,3-diarylpyrazolines, naphthalimides, benzoxazole, benzisoxazole and benzimidazole systems and the pyrene derivatives substituted by heterocycles. The optical brighteners are usually used in amounts of from 0.03 to 0.3% by weight, based on the prepared composition.

Graying inhibitors have the function of keeping the dirt detached from the fiber in suspension in the liquor and thus preventing reabsorption of the dirt. Water-soluble colloids, generally organic ones, are suitable for this purpose, for example glue, gelatin, salts of ethersulfonic acids of starch or of cellulose or salts of acidic sulfuric esters of cellulose or of starch. Water-soluble polyamides containing acidic groups are also suitable for this purpose. Furthermore, soluble starch preparations and starch products other than those mentioned above may be used, for example degraded starch, aldehyde starches, etc. Polyvinylpyrrolidone can also be used. However, cellulose ethers, such as carboxymethylcellulose (Na salt), methylcellulose, hydroxyalkylcellulose and mixed ethers, such as methylhydroxyethylcellulose, methylhydroxypropylcellulose, methylcarboxymethylcellulose and mixtures thereof, in amounts of from 0.1 to 5% by weight, based on the compositions, are preferably used.

Since sheet-like textile structures, in particular of rayon, rayon staple, cotton and blends thereof, may tend to crease because the individual fibers are sensitive to bending or flexing, pressing and squeezing transversely to the fiber direction, the compositions may contain synthetic anti-crease agents. These include, for example, synthetic products based on fatty acids, fatty esters, fatty amides, fatty alkylol esters, fatty alkylolamides or fatty alcohols, which are generally reacted with ethylene oxide, or products based on lecithin or modified phosphoric esters.

For controlling microorganisms, the liquid detergents and cleaning agents may contain antimicrobial active substances. Depending on the antimicrobial spectrum and action mechanism, a distinction is made here between bacteriostatic agents and bacteriocides, fungistatic agents and fungicides, etc. Important substances from these groups are, for example, benzalkonium chlorides, alkylarylsulfonates, halophenols and phenol mercuriacetate, it also being possible completely to dispense with these compounds in the case of the compositions according to the invention.

In order to prevent undesired changes to the liquid detergents and cleaning agents and/or the treated sheet-like textile structures which are due to the action of oxygen and other oxidative processes, the compositions may contain antioxidants. This class of compounds includes, for example, substituted phenols, hydroquinones, pyrocatechols and aromatic amines and organic sulfides, polysulfides, dithiocarbamates, phosphites and phosphonates.

Greater comfort during wear can result from the additional use of antistatic agents, which are also added to the compositions. Antistatic agents increase the surface conductivity and hence permit improved flowing away of resulting charges. External antistatic agents are as a rule substances having at least one hydrophilic molecular ligand and give a more or less hygroscopic film on the surfaces. These generally surface-active antistatic agents can be divided into nitrogen-containing (amines, amides, quaternary ammonium compounds), phosphorus-containing (phosphoric esters) and sulfur-containing (alkylsulfonates, alkylsulfates) antistatic agents. External antistatic agents are described, for example, in the patent applications FR 1,156,513, GB 873 214 and GB 839 407. The lauryl- (or stearyl)dimethylbenzylammonium chlorides disclosed here are suitable as antistatic agents for sheet-like textile structures or as an additive to detergents, a reviving effect additionally being achieved.

For improving the water absorptivity and the rewettability of the treated sheet-like textile structures and for facilitating ironing of the treated sheet-like textile structures, for example, silicone derivatives can be used in the liquid detergents and cleaning agents. These additionally improve the washout behavior of the compositions through their foam-inhibiting properties. Preferred silicone derivatives are, for example, polydialkyl- or alkylarylsiloxanes in which the alkyl groups have from one to five carbon atoms and are completely or partly fluorinated. Preferred silicones are polydimethylsiloxanes which may optionally be derivatized and are then amino-functional or quaternized or have Si—OH, Si—H and/or Si—Cl bonds. The viscosities of the preferred silicones at 25° C. are in the range from 100 to 100 000 mPa·s, it being possible for the silicones to be used in amounts of from 0.2 to 5% by weight, based on the total composition.

Finally, the liquid detergents and cleaning agents may also contain UV absorbers, which are adsorbed onto the treated sheet-like textile structures and improve the light stability of the fibers. Compounds which have these desired properties are, for example, those compounds and derivatives of benzophenone having substituents in the 2- and/or 4-position which are effective as a result of radiationless deactivation. Furthermore, substituted benzotriazoles, acrylates phenyl-substituted in the 3-position (cinnamic acid derivatives), optionally having cyano groups in the 2-position, salicylates, organic Ni complexes and natural substances, such as umbelliferone and the endogenous urocanic acid, are also suitable.

In order to avoid the decomposition of certain detergent ingredients which is catalyzed by heavy metals, it is possible to use substances which complex heavy metals. Suitable heavy metal complexing agents are, for example, the alkali metal salts of ethylenediaminetetraacetic acid (EDTA) or of nitrilotriacetic acid (NTA) and alkali metal salts of anionic polyelectrolytes, such as polymaleates and polysulfonates.

A preferred class of complexing agents are the phosphonates, which are present in preferred liquid detergents and cleaning agents in amounts of from 0.01 to 2.5% by weight, preferably from 0.02 to 2% by weight and in particular from 0.03 to 1.5% by weight. These preferred compounds include in particular organophosphonates, such as, for example, 1-hydroxyethane-1,1-diphosphonic acid (HEDP), aminotri(methylenephosphonic acid) (ATM P), diethylenetriaminepenta (methylenephosphonic acid) (DTPMP or DETPMP) and 2-phosphonobutane-1,2,4-tricarboxylic acid (PBS-AM), which are generally used in the form of their ammonium or alkali metal salts.

The aqueous liquid detergents and cleaning agents obtained are clear, i.e. they have no sediment and are preferably transparent or at least translucent. Preferably, the aqueous liquid detergents and cleaning agents have a transmittance of visible light of at least 30%, preferably 50% and particularly preferably 75%.

In addition to these constituents, an aqueous detergent and cleaning agent may contain dispersed particles whose diameter along their greatest dimension is from 0.01 to 10 000 μm.

In the context of this invention, particles may be microcapsules as well as granules, compounds and fragrance beads, microcapsules being preferred.

The term "microcapsules" is understood as meaning aggregates which contain at least one solid or liquid core which is enclosed by at least one continuous covering, in particular a covering of polymer(s). These are usually finely dispersed liquid or solid phases which are surrounded by film-forming polymers and in the preparation of which the polymers, after emulsification and coacervation or interfacial polymerization, are precipitated on the material to be surrounded. The microscopically small capsules can be dried like powder. In addition to mononuclear microcapsules, polynuclear aggregates, also referred to as microspheres, which contain two or more cores distributed in the continuous covering material, are also known. Mononuclear or polynuclear microcapsules may also be surrounded by an additional second, third, etc. covering. Mononuclear microcapsules having a continuous covering are preferred. The covering may consist of natural, semisynthetic or synthetic materials. Natural covering materials are, for example, gum arabic, agar agar, agarose, maltodextrins, alginic acid or its salts, e.g. sodium or calcium alginate, fats and fatty acids, cetyl alcohol, collagen, chitosan, lecithins, gelatin, albumin, shellac, polysaccharides, such as starch or dextran, sucrose and waxes. Semisynthetic covering materials are, inter alia, chemically modified celluloses, in particular cellulose esters and ethers, e.g. cellulose acetate, ethylcellulose, hydroxypropylcellulose, hydroxypropylmethylcellulose and carboxymethylcellulose, and starch derivatives, in particular starch ethers and esters. Synthetic covering materials are, for example, polymers, such as polyacrylates, polyamides, polyvinyl alcohol or polyvinylpyrrolidone.

Sensitive, chemically or physically incompatible and volatile components (=active substances) of the aqueous liquid detergent and cleaning agent may be enclosed in the interior of the microcapsules in a manner stable during storage and transport. For example, optical brighteners, surfactants, complexing agents, bleaches, bleach activators, dyes and fragrances, antioxidants, builders, enzymes, enzyme stabilizers, antimicrobial active substances, graying inhibitors, antiredeposition agents, pH adjusters, electrolytes, foam inhibitors and UV absorbers may be present in the microcapsules. In addition to the constituents, mentioned above not as ingredients of the aqueous liquid detergents and cleaning agents according to the invention, the microcapsules may contain, for example, cationic surfactants, vitamins, proteins, preservatives, detergent power enhancers or pearlizers. The fillings of the microcapsules may be solids or liquids in the form of solutions or emulsions or suspensions.

As a result of the preparation, the microcapsules may have any desired form but they are preferably approximately spherical. Their diameter along their greatest dimension can be from 0.01 μm (visually not recognizable as a capsule) to 10 000 μm depending on the components present in their interior and on the application. Visible microcapsules having a diameter in the range from 100 μm to 7000 μm, in particular from 400 μm to 5000 μm, are preferred. The microcapsules are obtainable by processes known in the prior art, the coacervation and the interfacial polymerization being of the greatest importance. Microcapsules used may be all microcapsules which are available on the market and stable to surfactants, for example the commercial products (the covering material is stated in each case in brackets) Halicrest Microcapsules (gelatin, gum arabic), Coletica Thalaspheres (maritime collagen), Lipotec Millicapsules (alginic acid, agar agar), Induchem Unispheres (lactose, microcrystalline cellulose, hydroxypropylmethylcellulose); Unicerin C30 (lactose, microcrystalline cellulose, hydroxypropylmethylcellulose), Kobo Glycospheres (modified starch, fatty esters, phospholipids), Softspheres (modified agar agar) and Kuhs Probiol Nanospheres (phospholipids).

Alternatively, it is also possible to use particles which have no core-shell structure but in which the active substance is distributed in a matrix of a matrix-forming material. Such particles are also referred to as "speckles".

A preferred matrix-forming material is alginate. For the preparation of alginate-based speckles, an aqueous alginate solution which also contains the active substance to be enclosed or the active substances to be enclosed is dripped and is then cured in a precipitating bath containing $Ca^{2+}$ ions or $Al^{3+}$ ions.

It may be advantageous if the alginate-based speckles are subsequently washed with water and then washed in an aqueous solution with a complexing agent in order to wash out free $Ca^{2+}$ ions or free $Al^{3+}$ ions which can undergo undesired interactions with ingredients of the liquid detergent and cleaning agent, e.g. the fatty acid soaps. The alginate-based speckles are then washed again with water in order to remove superfluous complexing agent.

Alternatively, instead of alginate, other, matrix-forming materials may be used. Examples of matrix-forming materials include polyethylene glycol, polyvinylpyrrolidone, polymethacrylate, polylysine, poloxamer, polyvinyl alcohol, polyacrylic acid, polyethylene oxide, polyethoxyoxazoline, albumin, gelatin, acacia, chitosan, cellulose, dextran, Ficoll®, starch, hydroxyethylcellulose, hydroxypropylcellulose, hydroxypropylmethylcellulose, hyaluronic acid, carboxymethylcellulose, carboxymethylcellulose, deacetylated chitosan, dextran sulfate and derivatives of these materials. The matrix formation is effected in the case of these materials, for example, by gelling, polyanion-polycation interactions or polyelectrolyte-metal ion interactions and is well known in the prior art, as is the preparation of particles having these matrix-forming materials.

The particles can be dispersed in a stable manner in the aqueous liquid detergents and cleaning agents. Stable means that the compositions are stable over a period of at least 4 weeks and preferably of at least 6 weeks at room temperature and at 40° C. without the compositions creaming or settling out.

The liberation of the active substances from the microcapsules or speckles usually takes place during the use of the compositions containing them, by destruction of the covering or of the matrix due to mechanical, thermal, chemical or enzymatic action. In a preferred embodiment of the invention, the liquid detergents and cleaning agents contain identical or different particles in amounts of from 0.01 to 10% by weight, in particular from 0.2 to 8% by weight and extremely preferably from 0.5 to 5% by weight.

The detergents and cleaning agents according to the invention can be used for cleaning sheet-like textile fabrics and/or hard surfaces.

For the preparation of the liquid detergents and cleaning agents, gellan gum is first added to water and allowed to swell at 80° C. Thereafter, a small amount of a salt solution, preferably having trivalent or divalent metal cations, such as $Al^{3+}$ or $Ca^{2+}$, is added. In the next step, the acidic components, such as, for example, the linear alkanesulfonates, citric acid, boric acid, phosphonic acid, the fatty alcohol ether sulfates, etc. and the nonionic surfactants are added. Thereafter, a base, such as, for example, NaOH, KOH, triethanolamine or monoethanolamine, is added, followed by the fatty acid, if present. Thereafter, the remaining ingredients and the solvents of the aqueous liquid detergent and cleaning agent and, if present, the polyacrylate thickener are added to the mixture and the pH is adjusted to about 8.5. Finally, the particles to be dispersed can be added and can be distributed homogeneously in the aqueous liquid detergent and cleaning agent by mixing.

If the thickening system of the detergent and cleaning agent contains a polysaccharide, such as, for example, xanthan gum as component b), this is first allowed to swell in water with the gellan gum.

EXAMPLES

Table 1 shows detergents and cleaning agents E1 to E3 according to the invention and comparative examples C1 to C5. The detergents and cleaning agents E1 to E3 obtained were clear and had a viscosity of 1000 mPa·s. The pH of the liquid detergents and cleaning agents was 8.5. All data are in percent by weight, based in each case on the total composition.

TABLE 1

| | E1 | E2 | E3 | C1 | C2 | C3 | C4 | C5 |
|---|---|---|---|---|---|---|---|---|
| Gellan gum | 0.2 | 0.2 | 0.15 | 0.15 | — | — | — | — |
| Xanthan gum | — | — | 0.15 | — | 0.15 | 0.5 | 0.2 | — |
| Polyacrylate (Carbopol Aqua 30) | 0.4 | 0.4 | — | — | — | — | 0.6 | 0.6 |
| $C_{12-14}$-fatty alcohol with 7 EO | 22 | 10 | 10 | 10 | 10 | 10 | 10 | 10 |
| $C_{9-13}$-alkylbenzenesulfonate, Na salt | — | 10 | 10 | 10 | 10 | 10 | 10 | 10 |
| $C_{12-14}$-alkylpolyglycoside | 1 | — | — | — | — | — | — | — |
| Citric acid | 1.6 | 3 | 3 | 3 | 3 | 3 | 3 | 3 |
| Dequest ® 2010 | 0.5 | 1 | 1 | 1 | 1 | 1 | 1 | 1 |
| Sodium laurylethersulfate with 2 EO | 10 | 5 | 5 | 5 | 5 | 5 | 5 | 5 |
| Monoethanolamine | 3 | 3 | 3 | 3 | 3 | 3 | 3 | 3 |
| $C_{12-18}$-fatty acid | 7.5 | 7.5 | 7.5 | 7.5 | 7.5 | 7.5 | 7.5 | 7.5 |
| Propylene glycol | — | 6.5 | 6.5 | 6.5 | 6.5 | 6.5 | 6.5 | 6.5 |
| Sodium cumenesulfonate | — | 2 | 2 | 2 | 2 | 2 | 2 | 2 |
| Enzymes, dyes, stabilizers | + | + | + | + | + | + | + | + |
| Microcapsules with about 2000 μm Ø | 0.5 | 0.5 | 0.5 | 0.5 | 0.5 | 0.5 | 0.5 | 0.5 |
| Water | to 100 | to 100 | to 100 | to 100 | to 100 | to 100 | to 100 | to 100 |
| Flow limit (Pas) | 0.58 | 1.16 | 1.16 | no | no | no | yes | no |
| | stable | stable | stable | unstable | unstable | unstable | unstable | stable |

Dequest ® 2010: Hydroxyethylidene-1,1-diphosphonic acid, tetrasodium salt (from Solutia)

Detergents and cleaning agents E1 to E3 were stable at room temperature and at 40° C. for 8 weeks.

From the examples, it is clear that only the combination of gellan gum with a selected thickener, in this case polyacrylate thickener or xanthan gum, has a synergistic effect and leads to a thickened clear detergent and cleaning agent having a flow limit.

Thus, a thickening system which contains only 0.6% by weight of polyacrylate thickener gives a stable liquid detergent and cleaning agent (C5) but this composition has no flow limit. The combination of 0.6% by weight of polyacrylate thickener and 0.2% by weight of xanthan gum also does not lead to stable compositions having a flow limit (C4). On the other hand, a liquid detergent and cleaning agent (E1 or E2) which contains 0.6% by weight of a thickening system according to the invention (0.2% by weight of gellan gum and 0.4% by weight of polyacrylate thickener) is stable and has a flow limit.

From the comparative examples C1 to C3, it is also clear that the use of a gum (gellan gum or xanthan gum) alone, even at different concentrations, does not lead to stable compositions having a flow limit. Surprisingly, a liquid detergent and cleaning agent (E3) comprising a thickening system of gellan gum and xanthan gum is stable and has a flow limit. Here too, a synergistic effect occurs due to the thickening system according to the invention.

What is claimed is:

1. An aqueous composition comprising:

(a) a surfactant; and (b) a thickening system comprising: (i) a gellan gum; and (ii) a thickener selected from the group consisting of polyacrylate thickeners, xanthan gums, and mixtures thereof present in an amount of 0.01 to 1.0% by weight, based on the composition;

wherein the surfactant comprises a fatty acid soap, and wherein the fatty acid soap is present in an amount of 2 to 20% by weight based on the composition.

2. The aqueous composition according to claim 1, wherein the fatty acid soap is present in an amount of 4 to 10% by weight based on the composition.

3. The aqueous composition according to claim 1, wherein the fatty acid soap is present in an amount of 6 to 8% by weight based on the composition.

4. The aqueous composition according to claim 1, wherein the gellan gum is present in an amount of 0.01 to 0.5% by weight based on the composition.

5. The aqueous composition according to claim 2, wherein the gellan gum is present in an amount of 0.01 to 0.5% by weight based on the composition.

6. The aqueous composition according to claim 3, wherein the gellan gum is present in an amount of 0.01 to 0.5% by weight based on the composition.

7. The aqueous composition according to claim 1, wherein the thickener comprises a polyacrylate thickener present in an amount of 0.01 to 1.0% by weight, based on the composition.

8. The aqueous composition according to claim 2, wherein the thickener comprises a polyacrylate thickener present in an amount of 0.01 to 1.0% by weight, based on the composition.

9. The aqueous composition according to claim 6, wherein the thickener comprises a polyacrylate thickener present in an amount of 0.01 to 1.0% by weight, based on the composition.

10. The aqueous composition according to claim 1, wherein the thickener comprises a xanthan gum present in an amount of 0.01 to 1.0% by weight, based on the composition.

11. The aqueous composition according to claim 2, wherein the thickener comprises a xanthan gum present in an amount of 0.01 to 1.0% by weight, based on the composition.

12. The aqueous composition according to claim 6, wherein the thickener comprises a xanthan gum present in an amount of 0.01 to 1.0% by weight, based on the composition.

13. The aqueous composition according to claim 1, wherein the composition comprises dispersed particles having a diameter along their greatest dimension of 0.01 to 10000 μm.

14. The aqueous composition according to claim 2, wherein the composition comprises dispersed particles having a diameter along their greatest dimension of 0.01 to 10000 μm.

15. The aqueous composition according to claim 6, wherein the composition comprises dispersed particles having a diameter along their greatest dimension of 0.01 to 10000 μm.

16. The aqueous composition according to claim 9, wherein the composition comprises dispersed particles having a diameter along their greatest dimension of 0.01 to 10000 μm.

17. The aqueous composition according to claim 12, wherein the composition comprises dispersed particles having a diameter along their greatest dimension of 0.01 to 10000 μm.

18. The aqueous composition according to claim 13, wherein the dispersed particles comprise microcapsules or speckles.

19. A cleaning sheet comprising a porous or absorbent substrate and an aqueous composition, wherein the aqueous composition comprises (a) a surfactant; and (b) a thickening system comprising: (i) a gellan gum; and (ii) a thickener selected from the group consisting of polyacrylate thickeners, xanthan gums, and mixtures thereof present in an amount of 0.01 to 1.0% by weight, based on the composition; wherein the surfactant comprises a fatty acid soap, and wherein the fatty acid soap is present in an amount of 2 to 20% by weight based on the composition.

20. A method comprising:

(a) providing an aqueous composition comprises (a) a surfactant; and (b) a thickening system comprising: (i) a gellan gum; and (ii) a thickener selected from the group consisting of polyacrylate thickeners, xanthan gums, and mixtures thereof present in an amount of 0.01 to 1.0% by weight, based on the composition; wherein the surfactant comprises a fatty acid soap, and wherein the fatty acid soap is present in an amount of 2 to 20% by weight based on the composition;

(b) contacting a hard surface with the aqueous composition.

* * * * *